United States Patent [19]

Ohe et al.

[11] 4,436,654

[45] Mar. 13, 1984

[54] FIRE-RETARDANT INSULATING OILS

[75] Inventors: Etsuo Ohe; Katsuo Sugawara, both of Hitachi; Ititaro Tani, Kitaibaraki; Hideo Tsukioka, Mito, all of Japan

[73] Assignee: Hitachi, Ltd., Tokyo, Japan

[21] Appl. No.: 376,125

[22] Filed: May 7, 1982

[30] Foreign Application Priority Data

May 8, 1981 [JP] Japan ..... 56-68168

[51] Int. Cl.[3] ..... H01B 3/24

[52] U.S. Cl. ..... 252/574; 252/579

[58] Field of Search ..... 252/574, 579

[56] References Cited

U.S. PATENT DOCUMENTS

| | | | |
|---|---|---|---|
| 3,894,959 | 7/1975 | Gardiner et al. | 252/579 |
| 4,082,866 | 4/1978 | Link | 174/17 LF |
| 4,163,731 | 8/1979 | Randell et al. | 252/574 |
| 4,259,708 | 3/1981 | Mandelcorn | 361/318 |

*Primary Examiner*—John E. Kittle
*Assistant Examiner*—Robert A. Wax
*Attorney, Agent, or Firm*—Antonelli, Terry & Wands

[57] ABSTRACT

A phosphoric triester containing at least one aromatic ring is mixed in an amount of 30 to 80% by weight based on the total constituents with a benzenetricarboxylic acid trialkyl ester or with a polyol ester obtained from trimethylolpropane and a saturated fatty acid to give a fire-retardant insulating oil.

14 Claims, No Drawings

FIRE-RETARDANT INSULATING OILS

BACKGROUND OF THE INVENTION

This invention relates to fire-retardant insulating oils.

Recently, electric machineries and tools such as oil-filled transformers, condensers and the like have been required to be fire-retardant and small-sized, and silicone oil has been substituted for PCB which has heretofore been used. Further, mixtures of an aryl phosphate and a mineral oil type insulating oil have already been known as insulating oils which are more inexpensive and fire-retardant than silicone oil. However, the mineral oil type insulating oils are disadvantageous in that in general, they are poor in solubility in aryl phosphates.

SUMMARY OF THE INVENTION

An object of this invention is to provide fire-retardant insulating oils improved in the disadvantages of the above-mentioned prior arts.

Another object of this invention is to provide fire-retardant, high-viscosity insulating oil improved in the disadvantages of the above-mentioned prior arts.

The present inventors have found that benzenetricarboxylic acid trialkyl esters or polyol esters obtained from trimethylolpropane and a saturated fatty acid can be dissolved in any ratio in phosphoric triesters containing at least one aromatic ring to form a fire retardant insulating oil and that an insulating oil obtained by further mixing any of the aforesaid insulating oil with a phosphoric acid trialkyl ester and/or an alkylphosphoric acid dialkyl ester is fire-retardant and have a low viscosity.

DETAILED DESCRIPTION OF THE INVENTION

This invention relates to insulating oils characterized in that a phosphoric triester containing at least one aromatic ring is mixed in an amount of 30 to 80% by weight based on the total constituents with a benzenetricarboxylic acid trialkyl ester or with a polyol ester obtained from trimethylolpropane and a saturated fatty acid. Further, this invention relates to insulating oils characterized in that a phosphoric acid trialkyl ester and/or an alkylphosphoric acid dialkyl ester are mixed in an amount of 10 to 80% by weight based on the total constituents with an insulating oil prepared by mixing a phosphoric triester containing at least one aromatic ring with the aforesaid benzentricarboxylic trialkyl ester or the aforesaid trimethylolpropane-saturated fatty acid type polyol ester in an amount of 30 to 80% by weight based on the sum of these two constituents.

Representatives of the benzentricarboxylic acid trialkyl ester used in this invention are represented by the following general formula:

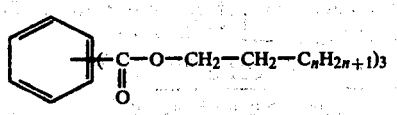

wherein n is an integer of 4 to 10. The alcohol component in the esters of the above formula has 6 to 12 carbon atoms, and when it has carbon atoms less than the lower limit, the esters have too low flash points, while when it has carbon atoms more than the upper limit, there is a possibility that the esters are not fluid at low temperature. Therefore, it is proper that the alcohol component had 6 to 12 carbon atoms.

Representatives of the trimethylolpropane-saturated fatty acid type polyol ester used in this invention is prepared from trimethylolpropane and a saturated fatty acid represented by the following general formula:

$$CH_3(CH_2)_nCOOH$$

wherein n is an integer of 3 to 11. The fatty acid of the above formula has 5 to 13 carbon atoms. When it has less than 5 carbon atoms, the polyol esters have too low flash points, while when it has more then 13 carbon atoms, there is a possibility that the polyol esters are not fluid at low temperatures. Therefore, it is proper that the saturated fatty acid has 5 to 13 carbon atoms. When a mixture of a plurality of saturated fatty acids having 5 to 13 carbon atoms is used as said fatty acid, an insulating oil having a relatively low pour point can be obtained.

The phosphoric triester containing at least one aromatic ring which is mixed with the above-mentioned constituents is an orthophosphoric triester in which at least one of three ester components contains an aromatic ring. Examples of the phosphoric triester are tricresyl phosphate, cresyldiphenyl phosphate, octyldiphenyl phosphate, trixylenyl phosphate, diphenylorthoxylenyl phosphate, tri(ethylphenyl) phosphate, tri(isopropylphenyl) phosphate, phenyldi(isopropylphenyl) phosphate, tri(n-propylphenyl) phosphate, tri(butylphenyl) phosphate, tri(pentylphenyl) phosphate, tri(hexylphenyl) phosphate, tri(heptylphenyl) phosphate, tri(octylphenyl) phosphate, tri(nonylphenyl), phosphate, tri(decylphenyl) phosphate, and the like. These esters may be incorporated alone or in admixture.

Representatives of the phosphoric acid trialkyl ester are represented by the following general formula:

$$(C_nH_{2n+1}O)_3P{=}0$$

wherein n is an integer of 4 to 11. Examples of the phosphoric acid trialkyl esters represented by the above general formula are esters such as tributyl phosphate, tripentyl phosphate, trihexyl phosphate, triheptyl phosphate, trioctyl phosphate, trinonyl phosphate, tridecyl phosphate, triundecyl phosphate, and the like.

Further, representatives of the alkylphosphonic acid dialkyl ester are represented by the following general formula:

$$(C_nH_{2n+1}O)_2P(\overset{\overset{\displaystyle O}{\|}}{C}{}_mH_{2m+1})$$

wherein m and n may be the same or different and are individually an integer of 4 to 9.

Examples of the alkylphosphonic acid dialkyl esters represented by the above general formula are esters such as dibutyl butylphosphonate, dipentyl pentylphosphonate, dihexyl hexylphosphonate, diheptyl heptylphosphonate, dioctyl octylphosphonate, dinonyl nonylphosphonate, dibutyl octylphosphonate, and the like.

The above-mentioned phosphoric acid trialkyl esters and alkylphosphonic acid dialkyl esters may individually be incorporated alone or in admixture. When the numbers (m and n) are less than 4, the esters are poor in miscibility with other esters, while when they are more than the upper limit, there is a possibility that the esters are not fluid.

The amount of the phosphoric triester containing at least one aromatic ring which is mixed with the benzenetricarboxylic acid trialkyl ester or the trimethylolpropane-saturated fatty acid type polyol ester is suitably 30 to 80% by weight, more preferably 40 to 80% by weight. When the amount is less than the lower limit, fire-retarding effect can not be expected. On the other hand, when the amount is more than the upper limit, the dielectric loss tangent of the resulting oil becomes undesirably high.

Further, the amount of the phosphoric acid trialkyl ester and/or alkylphosphonic acid dialkyl ester incorporated into the aforesaid insulating oil is effective when it is 10% by weight or more based on the total amount from the viewpoint of the reduction of viscosity. On the other hand, when the amount thereof exceeds 80% by weight, the dielectric loss tangent of the resulting oil becomes undesirably high. Accordingly, the amount thereof is suitably 10 to 80% by weight.

The effects of this invention are explained in detail referring to Examples, which are not by way of limitation but by way of illustration. The combustibilities of the oils in Examples and Comparative Examples were measured in the following manner.

A glass tape of 25 mm in width, 500 mm in length and 0.25 mm in thickness was immersed in 50 ml of each test oil for 3 minutes, taken out from the oil, and then allowed to stand horizontally for 2 minutes, after which one end of the glass tape was ignited with a flame from a gas burner. The combustibility was evaluated in terms of the combustion rate (sec./cm) after the ignition. When the glass tape was ignited and then the fire went out, the glass tape was thought to be incombustible.

EXAMPLE 1

Trixylenyl phosphate was mixed with each of four benzentricarboxylic acid trialkyl esters. The amount of trixylenyl phosphate was in the range from 10 to 90% by weight based on the sum of these two constituents. The combustibilities of the insulating oils thus obtained were measured.

Further, trioctyl trimellitate was mixed with each of four phosphoric triesters containing at least one aromatic ring. The amount of trioctyl trimellitate is 10 to 90% by weight based on the sum of these two constituents. The combustibilities of the insulating oils thus obtained were measured. The results obtained in each experiment as shown in Tables 1 and 2, respectively.

TABLE 1

(Combustion rate of insulating oil)
Unit: (sec/cm)

| Benzene-tricarboxylic acid trialkyl ester | Mixed amount of trixylenyl phosphate (% by weight) 10 | 20 | 30 | 40 | 50 | 60 | 70 | 90 |
|---|---|---|---|---|---|---|---|---|
| Trihexyl trimellitate | 0.16 | 0.15 | 0.14 | Incombustible | Incombustible | Incombustible | Incombustible | Incombustible |
| Triheptyl trimellitate | 0.16 | 0.15 | 0.14 | " | " | " | " | " |
| Trioctyl trimellitate | 0.16 | 0.15 | 0.13 | " | " | " | " | " |
| Triisodecyl trimellitate | 0.16 | 0.15 | 0.13 | " | " | " | " | " |

TABLE 2

(Combustion rate of insulating oil)
Unit: (sec/cm)

| Phosphoric triester | Mixed amount of trioctyl trimellitate (% by weight) 10 | 30 | 40 | 50 | 60 | 70 | 80 | 90 |
|---|---|---|---|---|---|---|---|---|
| Octyldiphenyl phosphate | Incombustible | Incombustible | Incombustible | Incombustible | 0.14 | 0.15 | 0.16 | 0.16 |
| Cresyldiphenyl phosphate | " | " | " | " | 0.13 | 0.15 | 0.16 | 0.16 |
| Tricresyl phosphate | " | " | " | " | 0.13 | 0.15 | 0.16 | 0.16 |
| Xylenyldiphenyl phosphate | " | " | " | " | Incombustible | 0.13 | 0.14 | 0.13 |

As is evident from Tables 1 and 2, when a phosphoric triester containing at least one aromatic ring is mixed in an amount of more than 30% by weight based on the sum of these two constituents with a benzenetricarboxylic acid trialkyl ester, the resulting insulating oil is self-extinguishable. When the phosphoric triester is mixed in an amount of 30% by weight, an insulating oil having a combustion rate comparable to that of silicone oil can be obtained. The mixed amount of the phosphoric triester is desired to be 30% by weight or more, preferably 40% by weight or more.

EXAMPLE 2

Trioctyl phosphate or dibutyl butylphosphonate was mixed with an oil prepared by mixing trixylenyl phosphate and trioctyl trimellitate in the proportion of 60:40. The amount of trioctyl phosphate or dibutyl butylphosphonate is 10 to 40% by weight based on the total constitutents. The viscosities of the thus obtained compositions were measured.

The results obtained in each case are shown in Tables 3 and 4, respectively.

TABLE 3

(Viscosity of insulating oil)
Unit: cSt (30° C.)

| | Mixed amout of trioctyl phosphate (% by weight) 0 | 10 | 20 | 30 | 40 |
|---|---|---|---|---|---|
| Trixylenyl phosphate-trioctyl trimellitate (60:40) | 116 | 81 | 60 | 44 | 33 |

TABLE 4

(Viscosity of insulating oil)

| | Unit: cSt (30° C.) Mixed amount of dibutyl butylphosphonate (% by weight) | | | | |
|---|---|---|---|---|---|
| | 0 | 10 | 20 | 30 | 40 |
| Trixylenyl phosphate-trioctyl trimellitate (60:40) | 116 | 65 | 40 | 26 | 17 |

It can be seen from Tables 3 and 4 that when the phosphoric acid trialkyl ester or the alkylphosphonic acid dialkyl ester is mixed with the insulating oil in Example 1 in an amount of 10% by weight or more based on the total constituents, the resulting insulating oil has a greatly lowered viscosity. It can also been seen that by incorporating these phosphoric acid trialkyl ester and/or alkylphosphonic acid dialkyl ester to the above-mentioned insulating oil, there can also be obtained a fire-retardant and low-viscosity insulating oil.

EXAMPLE 3

Tricresyl phosphate was mixed with trioctyl trimellitate, and the dielectric loss tangent of the resulting insulating oil was measured. Further, trioctyl phosphate was mixed with an insulating oil prepared by mixing trioctyl trimellitate and tricresyl phosphate in the proportion of 50:50, and the dielectric loss tangent of the resulting insulating oil was measured.

The results obtained in each experiment are shown in Tables 5 and 6, respectively.

TABLE 5

(Dielectric loss tangent of insulating oil)

| | Unit: % (80° C.) Mixed amount of tricresyl phosphate (% by weight) | | | | | |
|---|---|---|---|---|---|---|
| | 0 | 20 | 50 | 70 | 80 | 90 |
| Trioctyl trimellitate | 0.8 | 1.0 | 1.4 | 2.0 | 2.4 | 4.0 |

TABLE 6

(Dielectric loss tangent of insulating oil)

| | Unit: % (80° C.) Mixed amount of trioctyl phosphate (% by weight) | | | | | |
|---|---|---|---|---|---|---|
| | 0 | 20 | 50 | 70 | 80 | 90 |
| Trioctyl trimellitate-tricresyl phosphate (50:50) | 1.4 | 1.6 | 2.1 | 2.4 | 3.0 | 5.2 |

It can be seen from Tables 5 and 6 that the amount of the phosphoric triester containing at least one aromatic ring which is mixed with trioctyl trimellitate may be up to 90% by weight from the viewpoint of the fire-retardancy but is suitably 80% or less because the dielectric loss tangent is large when it is more than 80% by weight.

It can be also seen that the amount of the phosphoric trialkyl ester and/or alkylphosphonic acid dialkyl ester to be mixed with the insulating oils above obtained is also suitably 80% by weight or less from the viewpoint of the dielectric loss tangent.

EXAMPLE 4

Trixylenyl phosphate was mixed with each of four kinds of trimethylolpropane-saturated fatty acid type polyol esters in an amount of 10 to 90% by weight based on the sum of these two constituents, and the combustibilities of the insulating oils thus obtained were measured.

Further, trimethylolpropane-caprylic acid type polyol ester was mixed with each of four phosphoric triesters containing at least one aromatic ring in an amount of 10 to 90% by weight based on the sum of these two constituents, and the combustibilities of the insulating oils thus obtained were measured. The results obtained in each experiment are shown in Tables 7 and 8, respectively.

TABLE 7

(Combustion rate of insulating oil)

| Fatty acid in polyol ester | Unit: (sec/cm) Mixed amount of trixylenyl phosphate (% by weight) | | | | | | | |
|---|---|---|---|---|---|---|---|---|
| | 10 | 20 | 30 | 40 | 50 | 60 | 70 | 90 |
| Caproic acid | 0.25 | 0.21 | 0.15 | Incombustible | Incombustible | Incombustible | Incombustible | Incombustible |
| Enanthic acid | 0.26 | 0.23 | 0.16 | " | " | " | " | " |
| Caprylic acid | 0.25 | 0.21 | 0.15 | " | " | " | " | " |
| Pelargonic acid | 0.21 | 0.17 | 0.16 | " | " | " | " | " |
| 2-Ethylhexanoic acid | 0.24 | 0.21 | 0.13 | " | " | " | " | " |
| Mixed fatty acid of $C_5$ to $C_{11}$ | 0.24 | 0.21 | 0.16 | " | " | " | " | " |
| Mixed fatty acid of $C_6$ to $C_{12}$ | 0.25 | 0.21 | 0.15 | " | " | " | " | " |
| 2-Ethylhexanoic acid-lauric acid | 0.20 | 0.17 | 0.10 | " | " | " | " | " |
| Isodecanoic acid-lauric acid | 0.22 | 0.18 | 0.16 | " | " | " | " | " |
| Isooctanoic acid-lauric acid | 0.23 | 0.20 | 0.12 | " | " | " | " | " |

TABLE 8

(Combustion rate of insulating oil)

| Phosphoric triester | Unit: (sec/cm) Mixed amount of polyol ester (% by weight) | | | | | | | |
|---|---|---|---|---|---|---|---|---|
| | 10 | 30 | 40 | 50 | 60 | 70 | 80 | 90 |
| Octyldiphenyl phosphate | Incombustible | Incombustible | Incombustible | Incombustible | Incombustible | 0.17 | 0.21 | 0.26 |

TABLE 8-continued

| Phosphoric triester | (Combustion rate of insulating oil) Unit: (sec/cm) Mixed amount of polyol ester (% by weight) 10 | 30 | 40 | 50 | 60 | 70 | 80 | 90 |
|---|---|---|---|---|---|---|---|---|
| Cresyldiphenyl phosphate | " | " | " | " | " | 0.19 | 0.23 | 0.27 |
| Tricresyl phosphate | " | " | " | " | " | 0.17 | 0.22 | 0.26 |
| Xylenyldiphenyl phosphate | " | " | " | " | " | 0.15 | 0.21 | 0.25 |

As is evident from Tables 7 to 8, when a phosphoric triester containing at least one aromatic ring is mixed with a trimethylolpropane-saturated fatty acid type polyol ester in an amount of 30% by weight or more based on the sum of these two constituents, a fire-retardancy was equal to or higher than that of silicone oil. The mixed amount of the phosphoric triester is desired to be 30% by weight or more, preferably 40% by weight or more.

EXAMPLE 5

Trioctyl phosphate or dibutyl butylphosphonate was mixed in an amount of 10 to 40% by weight based on the total constituents with an oil prepared by mixing trixylenyl phosphate with trimethylolpropane-mixed $C_6$–$C_{12}$ fatty acid type polyol ester in the proportion of 60:40, and the viscosities of the insulating oils thus obtained were measured.

The results obtained in each case are shown in Tables 9 and 10, respectively.

TABLE 9

| | (Viscosity of insulating oil) Unit: cSt (30° C.) Mixed amount of trioctyl phosphate (% by weight) 0 | 10 | 20 | 30 | 40 |
|---|---|---|---|---|---|
| Trixylenyl phosphate-polyol ester (60:40) | 53 | 42 | 34 | 27 | 23 |

TABLE 10

| | (Viscosity of insulating oil) Unit: cSt (30° C.) Mixed amount of dibutyl butylphosphonate (% by weight) 0 | 10 | 20 | 30 | 40 |
|---|---|---|---|---|---|
| Trixylenyl phosphate-polyol ester (60:40) | 53 | 36 | 34 | 17 | 13 |

It can be seen from Table 9 and 10 that when the phosphoric acid trialkyl ester or the alkylphosphonic acid dialkyl ester is mixed with the insulating oil in Example 1 in an amount of 10% by weight or more based on the total constituents, the resulting insulating oil has a greatly lowered viscosity. It can also be seen that by incorporating these phosphoric acid trialkyl ester and/or alkylphosphonic acid dialkyl ester, there can also be obtained a fire-retardant and low-viscosity insulating oil.

EXAMPLE 6

Tricresyl phosphate was mixed with trimethylolpropane-mixed $C_6$–$C_{12}$ fatty acid type polyol ester, and the dielectric loss tangent of the resulting insulating oil was measured. Further, trioctyl phosphate was mixed with an insulating oil prepared by mixing trimethylolpropane-mixed $C_6$–$C_{12}$ fatty acid type polyol ester and tricresyl phosphate in the proportion of 50:50, the dielectric loss tangent of the resulting insulating oil was measured. The results obtained in each experiment are shown in Tables 11 and 12.

TABLE 11

| | (Dielectric loss tangent of insulating oil) Unit: % (80° C.) Mixed amount of tricresyl phosphate (% by weight) 0 | 20 | 50 | 70 | 80 | 90 |
|---|---|---|---|---|---|---|
| Polyol ester | 1.0 | 1.2 | 1.6 | 2.3 | 2.8 | 4.4 |

TABLE 12

| | (Dielectic loss tangent of insulating oil) Units: % (80° C.) Mixed amount of trioctyl phosphate (% by weight) 0 | 20 | 50 | 70 | 80 | 90 |
|---|---|---|---|---|---|---|
| Polyol ester-tricresyl phosphate (50:50) | 1.7 | 1.9 | 2.3 | 2.6 | 3.2 | 5.6 |

It can be seen from Tables 11 and 12 that the amount of the phosphoric triester containing at least one aromatic ring which is mixed with the polyol ester may be up to 90% by weight from the viewpoint of the fire-retardancy but is suitably 80% by weight or less because the dielectric loss tangent is large when it is more than 80% by weight.

It can also be seen that the amount of the phosphoric acid trialkyl ester and/or the alkylphosphonic acid dialkyl ester to be mixed with the insulating oils above obtained is also suitably 80% by weight or less from the viewpoint of the dielectric loss tangent.

As explained above, the fire-retardant insulating oils of this invention are useful as insulating oils for oil-filled electric machineries and tools which are required to be small-sized and fire-retardant because they are fire-retardant and can be reduced in viscosity if necessary.

What is claimed is:

1. An insulating oil characterized in that a phosphoric triester containing at least one aromatic ring is mixed with a benzenetricarboxylic acid trialkyl ester or with a polyol ester obtained from trimethylolpropane and a saturated fatty acid, said triester being mixed in an amount of 30 to 80% by weight based on the total weight of said triester and either said benzenetricarboxylic acid trialkyl ester or said polyol ester.

2. An insulating oil according to claim 1, further including a phosphoric acid trialkyl ester and/or alkylphosphonic acid dialkyl ester, and wherein the phosphoric acid trialkyl ester and/or alklyphosphonic acid dialkyl ester is incorporated in an amount of 10 to 80% by weight based on the weight of the total constituents.

3. An insulating oil according to claim 1 or 2, wherein the benzenetricarboxylic acid trialkyl ester is represented by the following general formula;

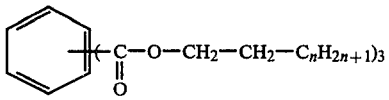

wherein n is an integer of 4 to 10.

4. An insulating oil according to claim 1 or 2, wherein the saturated fatty acid is at least one saturated fatty acid having 5 to 13 carbon atoms.

5. An insulating oil according to claim 1 or 2, wherein the saturated fatty acid is represented by the general formula;

$$CH_3(CH_2)_nCOOH$$

wherein n is an integer of 3 to 11.

6. An insulating oil according to claim 1 or 2, wherein the phosphoric triester containing at least one aromatic ring is an orthophosphoric triester in which at least one of three ester components contains an aromatic ring said orthophosphoric triester being selected from the group consisting of tricresyl phosphate, cresyldiphenyl phosphate, octyldiphenyl phosphate, trixylenyl phosphate, diphenylorthoxylenyl phosphate, tri(ethylphenyl) phosphate, tri(isopropylphenyl) phosphate, phenyldi(isopropylphenyl) phosphate, tri(n-propylphenyl) phosphate, tri(butylphenyl) phosphate, tri(pentylphenyl) phosphate, tri(hexylphenyl) phosphate, tri(heptylphenyl) phosphate, tri(octylphenyl) phosphate, tri(nonylphenyl) phosphate, tri(decylphenyl) phosphate, and a mixture thereof.

7. An insulating oil according to claim 2, wherein the phosphoric acid trialkyl ester is represented by the general formula;

$$(C_nH_{2n+1}O)_3P{=}0$$

wherein n is an integer of 4 to 11.

8. An insulating oil according to claim 2, wherein the alkylphosphonic acid dialkyl ester are represented by the following general formula:

$$(C_nH_{2n+1}O)_2\overset{\overset{\displaystyle O}{\|}}{P}(C_mH_{2m+1})$$

wherein m and n may be the same or different and are individually an integer of 4 to 9.

9. An insulating oil according to claim 8, wherein the alkylphosphonic acid dialkyl esters represented by the above general formula are esters selected from the group consisting of dibutyl butylphosphonate, dipentyl pentylphosphonate, dihexyl hexylphosphonate, diheptyl heptylphosphonate, dioctyl octylphosphonate, dinonyl nonylphosphonate, and dibutyl octylphosphonate.

10. An insulating oil according to claim 1 or 2, wherein the phosphoric triester is mixed in an amount of 50 to 80% by weight based on the total weight of the triester and the benzenetricarboxylic acid trialkyl ester or polyol ester.

11. An insulating oil characterized in that a phosphoric triester containing at least one aromatic ring is mixed with a benzenetricarboxylic acid trialkyl ester or with a polyol ester obtained from trimethylolpropane and a saturated fatty acid, said phosphoric triester being mixed in such an amount that a combustion rate of the insulating oil becomes less than 0.15 sec/cm.

12. An insulating oil according to claim 1, 2 or 11, wherein said phosphoric triester is mixed with said benzenetricarboxylic acid trialkyl ester.

13. An insulating oil accordin to claim 1, 2 or 11, wherein the phosphoric triester is mixed with said polyol ester obtained from trimethylolpropane and a saturated fatty acid.

14. An insulating oil characterized in that a phosphoric triester containing at least one aromatic ring is mixed with a benzenetricarboxylic acid trialkyl ester or with a polyol ester obtained from trimethylolpropane and a saturated fatty acid, the phosphoric triester being mixed in such an amount that the insulating oil is incombustible.

* * * * *